US005215395A

United States Patent [19]

Grimm et al.

[11] Patent Number: 5,215,395

[45] Date of Patent: Jun. 1, 1993

[54] PRINTER CHASSIS

[75] Inventors: Thomas R. Grimm, Troy; Erik A. Treszoks, Temple; Luther L. Oliver, Austin; Sam Vinson, Temple; Jose I. Rodriguez, Garland, all of Tex.

[73] Assignee: Texas Instruments Incorporated, Dallas, Tex.

[21] Appl. No.: 349,366

[22] Filed: May 9, 1989

[51] Int. Cl.[5] ..... B41J 29/02

[52] U.S. Cl. ..... 400/691; 400/693

[58] Field of Search ..... 400/691, 693, 611, 613, 400/692, 613.2

[56] References Cited

U.S. PATENT DOCUMENTS

| | | | |
|---|---|---|---|
| 3,593,833 | 7/1971 | Bretti | 400/613 |
| 4,165,029 | 8/1979 | Mitchell | 400/613 |
| 4,744,680 | 5/1988 | Hirosaki et al. | 400/613 |
| 4,826,335 | 5/1989 | Kimura | 400/613.2 |
| 4,848,945 | 7/1989 | Sone | 400/613 |

FOREIGN PATENT DOCUMENTS

| | | | |
|---|---|---|---|
| 0120320 | 10/1984 | European Pat. Off. | 400/691 |
| 0055277 | 4/1983 | Japan | 400/613 |
| 0152865 | 8/1984 | Japan | 400/613 |
| 0206683 | 10/1985 | Japan | 400/613 |
| 0116573 | 6/1986 | Japan | 400/613 |
| 0083164 | 4/1987 | Japan | 400/613 |
| 0282958 | 12/1987 | Japan | 400/613 |
| 2191150 | 12/1987 | United Kingdom | 400/691 |

*Primary Examiner*—Edgar S. Burr
*Assistant Examiner*—John S. Hilten
*Attorney, Agent, or Firm*—Pehr Jansson; Robby T. Holland; Richard Donaldson

[57] ABSTRACT

A chassis for a portable printer wherein the structural members of the chassis not only makes the chassis more rigid, but each serves a functional role.

10 Claims, 2 Drawing Sheets

PRINTER CHASSIS

FIELD OF THE INVENTION

This invention relates generally to printers that are operable in connection with a processor such as a terminal or computer. More particularly, but not by way of limitation, this invention relates to an improved chassis for an ink jet printer or the like.

BACKGROUND OF THE INVENTION

Small, portable printers for use with computers have become very desirable with the advent of portable computers such as the lap top computers and terminals. Naturally, and since such printers are intended to be portable, it is highly desirable that they be as small and light as possible. Furthermore, the computer business is extremely competitive and the reduction in sales price by price saving during manufacture of the printer is of major significance.

In addition to the foregoing, the advance in the printer art has demanded that such printers be more and more accurate and that they produce not only high quality characters, but that the graphics produced thereby have the very best high definition.

For the most part, the portable printers have been of the dot matrix type which includes mechanical, pin-type printers, thermal printers, or ink jet printers. Among these, an ink jet printer, referred to as a "Think Jet" manufactured by Hewlett Packard has proved to be very successful since it is light weight, relatively low in cost, and totally portable.

In ink jet printers, the letters or graphics are formed by the disposition of ink that is sprayed or spurted onto the paper. There is no mechanical impact such as is true of the mechanical pin-type printers. Accordingly, it has been possible to eliminate the need for a heavy, large platen that is required to absorb the mechanical impact that occurs during the transfer of the characters to paper.

As a result of the accuracy demanded, the printers have certain problems in common. For example, accuracy and repeatability of paper feed when advancing the paper is required. Paper feed accuracy may be affected if there is backlash in the mechanism driving the paper through the printer. Also, a problem that has to be considered in the design of such printers is the necessity for locating the position of the print head vertically with respect to the paper feed. For example, to avoid printing into a lower or upper margin, or, printing over the perforations in continuous feed forms, it is necessary to know where the print head is located vertically so that the printer will skip to the next page or form and begin printing at the appropriate position.

One other problem encountered in the manufacture of portable printers, is the weight of the printer itself. It is highly desirable to reduce all stresses within the printer to be able to reduce the number of structural members that are required to provide a rigid chassis for supporting the paper, paper advance mechanism and the print head and to maintain those devices in their relative positions to maintain printer accuracy.

In addition to the foregoing problems, it is highly desirable in a portable printer to be able to print on individual sheets, rolled paper or on continuous feed form paper. Manifestly, such an arrangement can be provided, but the complexity, weight and cost of such mechanism must be suitable for use in a portable printer.

SUMMARY OF THE INVENTION

This invention provides an improved chassis structure for computer driven printers and the like comprising: a pair of spaced side frame members; a roll paper receiving member extending between and connected to the side frames; a paper guide member extending between and connected to the side frame; and a carriage guide member extending between and connected to a side frame.

The side members are connected to provide a substantially rigid chassis and the paper receiving member, paper guide member and carriage guide member also support a roll of print paper, direct print paper around a drive roller and stabilize the print head, respectively.

TECHNICAL ADVANTAGE

The technical advantage of this invention is the provision of an improved chassis for a printer that enables such chassis to made at a lower cost, and with less weight while producing maximum rigidity for obtaining accuracy of the print.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
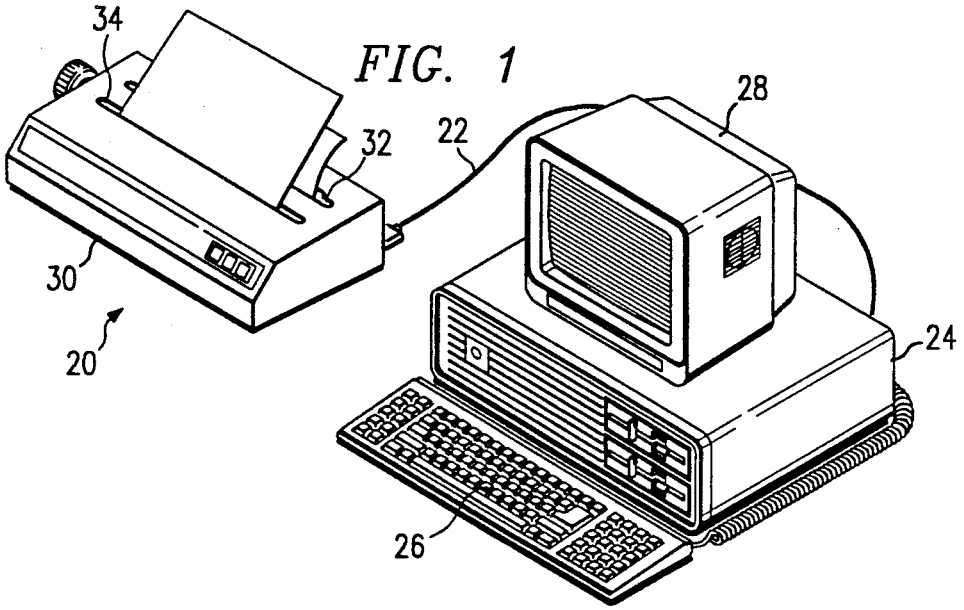
FIG. 1 is a view of a computer terminal containing a processor connected to a portable printer that is constructed in accordance with the invention.

Referring to the drawing and to FIG. 1 in particular, shown therein and generally designated by the reference character 20 is a portable printer that is constructed in accordance with the invention. The printer 20 is connected by an appropriate cable 22 with a processor 24 that is illustrated as including a key board 26 and a monitor 28. Manifestly, the processor 24 may either be a computer or a terminal so long as it is provided with appropriate software for driving the printer 20. The printer 20 includes a case 30 having a paper "in" slot 32 and a paper "out" slot 34 formed therein.

Figure 2:
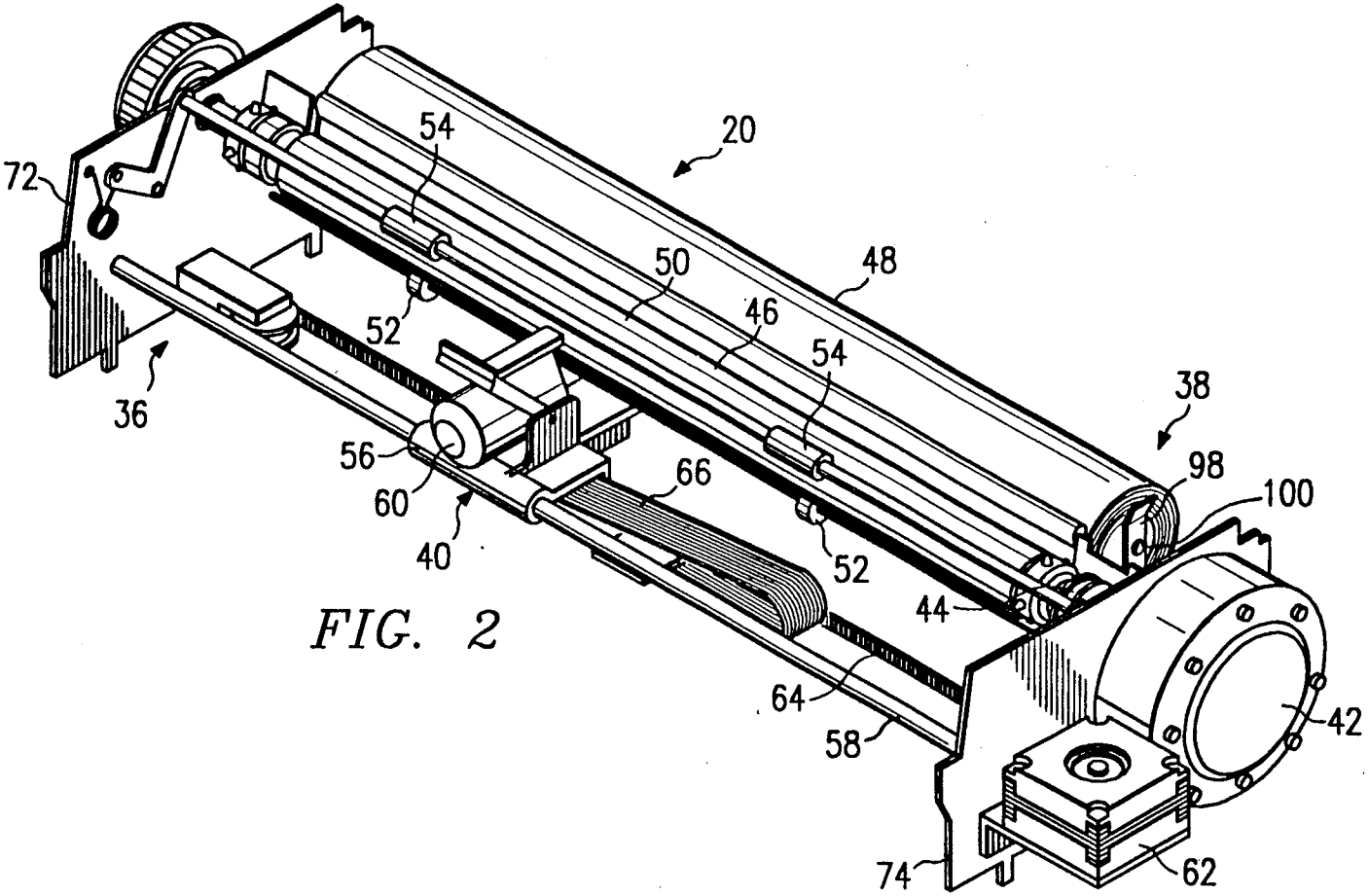
FIG. 2 is an isometric view of the internal components of the printer of FIG. 1 removed from the case.

Referring to FIG. 2, the case 30 has been removed from the printer 20 disclosing a printer chassis that is generally designated by the reference character 36, a paper feed system that is generally designated by the reference character 38 and a printer head assembly generally designated by the reference character 40.

The paper feed system 38 includes a paper feed drive motor 42 which, through belt drive 44 drives a paper feed roller 46. As illustrated therein, a roll of paper 48 is fed between the roller 46 and a paper guide member 50. The paper is held in tight engagement with the feed roller 46 by friction rollers 52 and bail rollers 54. As will be described more completely hereinafter, the printer 20 will also handle sheet paper and tractor or pin feed paper.

The printer head assembly 40 includes a carriage 56 that is slideable on a carriage bar or rod 58 that extends transversely across the printer 20. The carriage 56 carries an ink cartridge 60 which is appropriately arranged to deliver spurts of ink onto the surface of the paper to form the desired characters.

For the purpose of driving the carriage 56 across the printer 20, a motor 62 is mounted on one end thereof and drives a cog belt 64 carrying the carriage 56 back and forth across the printer 20. The intelligence to direct the carriage 56 to the appropriate position on the paper and to determine which characters are to be printed is transmitted through the cable 22. A conductor strap 66 is provided through which appropriate signals are transmitted to determine which character will be formed on the paper. The strap 66 is operably connected to the cable 22 through appropriate circuits (not shown).

THE PRINTER CHASSIS

Figure 3:
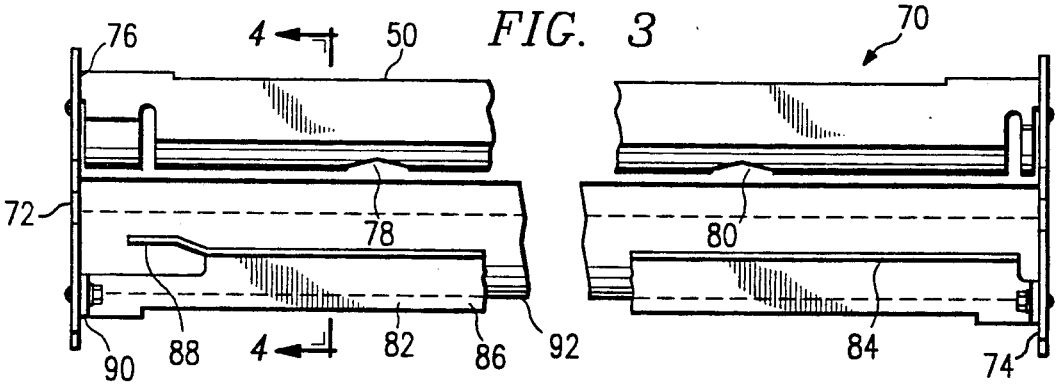
FIG. 3 is a front elevation view of a chassis for the printer of FIGS. 1 and 2 that is constructed in accordance with the invention.
Figure 4:
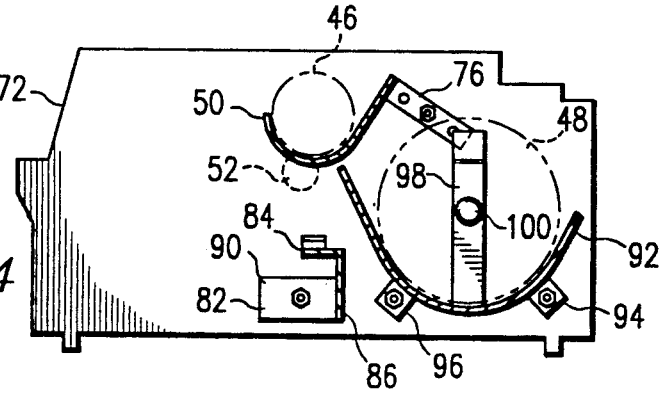
FIG. 4 is a side view, partially in cross-section, taken generally along the line 4—4 of FIG. 3 to more clearly show the structural arrangement of various parts of the chassis of FIG. 3.

The printer chassis which is generally designated by the reference character 70 is illustrated in FIGS. 3 and 4. As is evident from viewing those figures, all operating portions of the printer 20 except those related to the chassis 70 have been removed for clarity of description of the chassis.

In FIG. 3, it can be seen that the chassis includes first and second side plates 72 and 74 whose elevational configuration can be more clearly seen in FIG. 4. Essentially, the side frame members 72 and 74 are identical in configuration except as required to support various operational members as will be more apparent from viewing FIG. 2.

Extending between the side frame members 72 and 74 is a paper guide member 50. As shown most clearly in FIG. 4, the paper guide member 50 is of generally arcuate configuration with a concave upper surface and has a tab 76 projecting from each end by which the paper guide member 50 is secured to the side frames 72 and 74 with appropriate fasteners. The configuration of the paper guide member 50 is such that it is disposed the concave surface in juxtaposition with the exterior of the paper feed roller 46 which is shown by a dash line in FIG. 4. Through its lower side, the paper guide member 50 is provided with a pair of spaced openings 78 and 80 that receive the friction rollers 52.

The chassis 70 is also provided with a carriage guide member 82 that extends between the side frame members 72 and 74 and that is connected thereto by appropriate threaded fasteners. As illustrated more clearly in FIG. 4, the carriage guide member 82 includes elongated portions 84 and 86 that have a bend therebetween that is at an angle of about 90 degrees.

The left end 88 of the portion 84 has been bent upwardly and then horizontally as illustrated in FIG. 3 to provide a lift for the carriage 56 to tilt the carriage relatively away from the paper when at rest during the operation of the printer 20. The carriage guide member, that is the portion 84 thereof, engages a projecting arm (not shown) on the carriage 56 to maintain the carriage 56 in a horizontal position as it traverses across the printer 20. It will also be noted that the carriage guide member 82 is provided with tabs 90 for securing the carriage guide member 82 to the side frames 72 and 74.

To complete the structure of the chassis 70, there is provided a roll paper receiving member 92 that is arcuate in configuration with a concave upper surface as can be seen in FIG. 4. The roll paper receiving member 92 is provided with mounting tabs 94 and 96 on each end for securing the roll paper member 92 to the side frames 72 and 74 through appropriate threaded fasteners. It should be pointed out that while the structure illustrated is assembled with threaded fasteners through the various tabs described, the roll paper receiving member 92, the paper guide member 50 and the carriage guide member 82 can be secured to the side frame 72 and 74 in a suitable manner such as by welding.

In addition to the tabs 94, the paper receiving member 92 is also provided with a pair of upstanding roll support members 98 which are located relatively near the side frames 72 and 74. Each of the members 98 includes a pivot portion 100 that is arranged so that it will project slightly into the end of the paper roll 48 (see FIG. 2) to retain the paper roll 48 in the paper receiving member 92 and yet, let the paper roll rotate as necessary during the printing process. In addition, the members 98 are sufficiently flexible to permit the members 98 to move slightly apart to permit the insertion and removal of the paper roll 48.

From the foregoing, it will be appreciated that each of the members 50, 82 and 92 that extend between the side frame members 72 and 74 serve to render the chassis 70 more rigid while at the same time reducing the cost and weight of the chassis since each also performs its own individual function. For example, the paper guide member 50 functions to direct the paper, whether roll, sheet, or tractor feed into the appropriate position adjacent to the paper feed roller 46 to be printed upon. The carriage guide member 82 serves the additional function of maintaining the alignment of the carriage 56 during printing and the roll paper receiving member serves the additional function of pivotally supporting the paper roll 48.

Thus, it can be seen that the chassis 70 can be relatively inexpensively manufactured, will be of light weight, and will have the rigidity necessary to provide the printing accuracy now required of portable printers.

Having described but one embodiment of the invention, it will be understood that there can be many modifications thereto without departing from the spirit or scope of the invention.

What is claimed:

1. Improved chassis structure for computer driven printers and the like comprising:

a pair of spaced planar side frame members;

a roll paper receiving member extending between and connected to said side frames;

a paper guide member extending between and connected to said side frames; and a carriage guide member extending between and connected to said side frames, said members being connected to said side frames providing a rigid chassis and said paper receiving member also supporting a roll of printer paper, said paper guide member also directing print paper around a drive roller and said carriage guide member also stabilizing a print carriage.

2. The structure of claim 1 wherein said carriage guide member includes first and second elongated portions having a bend therebetween for providing rigidity to said structure, said second portion being disposed to provide a guide surface for cooperation with said print carriage.

3. The structure of claim 1 wherein said paper guide member has a generally arcuate cross-sectional configuration forming a concave surface disposed adjacent to said roller and for providing rigidity to said structure.

4. The structure of claim 3 wherein said carriage guide member includes first and second elongated portions having a bend therebetween for providing rigidity to said structure, said second portion being disposed to provide a guide surface for cooperation with said print carriage.

5. The structure of claim 1 wherein said roll paper receiving member has a generally arcuate cross-sectional configuration forming a concave surface for receiving said roll of paper and for providing rigidity to said structure.

6. The structure of claim 5 wherein said carriage guide member includes first and second elongated portions having a bend therebetween for providing rigidity to said structure, said second portion being disposed to provide a guide surface for cooperation with said print carriage.

7. The structure of claim 5 and also including spaced pivot members connected to said concave surface and projecting therefrom, said pivot members each including a pivot portion for insertion into the center of the paper roll and for providing a pivot about which the paper roll can rotate.

8. The structure of claim 5 wherein said paper guide member has a generally arcuate cross-sectional configuration forming a concave surface disposed adjacent to said roller and for providing rigidity to said structure.

9. The structure of claim 8 wherein said carriage guide member includes first and second elongated portions having a bend therebetween for providing rigidity to said structure, said second portion being disposed to provide a guide surface for cooperation with said print carriage.

10. The structure of claim 9 and also including spaced pivot members connected to said concave surface and projecting therefrom, said pivot members each including a pivot portion for insertion into the center of the paper roll and for providing a pivot about which the paper roll can rotate.

* * * * *